United States Patent [19]

Mezger

[11] Patent Number: 4,532,897

[45] Date of Patent: Aug. 6, 1985

[54] INTERNAL COMBUSTION ENGINE FOR VEHICLES IN PARTICULAR, FOR MOTORCYCLES

[75] Inventor: Hans Mezger, Freiberg, Fed. Rep. of Germany

[73] Assignee: Harley-Davidson Motor Co., Inc., Milwaukee, Wis.

[21] Appl. No.: 619,498

[22] Filed: Jun. 11, 1984

[30] Foreign Application Priority Data

Jun. 16, 1983 [DE] Fed. Rep. of Germany ..... 3321751

[51] Int. Cl.[3] ..... F01M 1/00

[52] U.S. Cl. ..... 123/196 R; 123/198 E; 184/6.5; 184/106

[58] Field of Search ..... 123/196 R, 196 A, 198 E; 184/6.5, 106

[56] References Cited

U.S. PATENT DOCUMENTS

| | | | |
|---|---|---|---|
| 2,618,351 | 11/1952 | Giacosa | 123/196 R |
| 3,106,263 | 10/1963 | McKellar | 123/196 R |
| 3,688,871 | 9/1972 | Krestan et al. | 184/6.5 |
| 4,457,274 | 7/1984 | Gottlob | 123/196 R |

FOREIGN PATENT DOCUMENTS

| | | | |
|---|---|---|---|
| 1948186 | 4/1971 | Fed. Rep. of Germany . | |
| 2751982 | 11/1982 | Fed. Rep. of Germany . | |
| 3146799 | 6/1983 | Fed. Rep. of Germany . | |
| 88416 | 5/1983 | Japan | 184/6.5 |
| 154620 | 10/1921 | United Kingdom . | |
| 1095948 | 12/1967 | United Kingdom . | |

OTHER PUBLICATIONS

"Das Kraftrad" 1957, N. R. 4.S.K. 80.

*Primary Examiner*—E. Rollins Cross

[57] ABSTRACT

The crankshaft of an internal combustion engine for vehicles, especially motorcycles, is mounted between upper and lower parts of a crankcase. The crank webs of the shaft rotate partially in the lower part which is in the form of an oil space. An oil sump is also provided in the lower part at a lower level than the oil space. The lower part of the crankcase has a curved floor formed at a distance from the crank webs, and such floor has one or more oil return ducts therein. The ducts are disposed in the vicinity of the path of movement of the crank webs. The ducts are, in fact, opposite the crank webs and each of the ducts have a slope to them. Each of the ducts extend between walls of bearing seats provided in the engine.

19 Claims, 4 Drawing Figures

INTERNAL COMBUSTION ENGINE FOR VEHICLES IN PARTICULAR, FOR MOTORCYCLES

BACKGROUND OF THE INVENTION

1. Field of the Invention

The present invention relates generally to the field of internal combustion engines and more particularly, to internal combustion engines for motorcycles. Still more particularly, the present invention relates to the design of the crankcase thereof to provide oil return ducts of a specific configuration to improve engine performance and prevent oil adulteration.

2. Description of the Prior Art

In vehicle internal combustion engines of the prior art, for example, the engine described in U.S. Pat. No. 3,688,871, considerable power losses occur due to oil adulteration. The adulteration affects the performance of the crankshaft, the crank webs and the connecting rod heads in the crankcase and in the oil space respectively. The adulteration problem is particularly increased if the distance between the outer path of movement of the crank webs (hereinafter "the envelope of crank web travel") and the floor of the oil space is very small. To increase such distance is contrary to other criteria of engine design, i.e., maintaining a very low structural height. That criteria is especially important in the design of internal combustion engines for motorcycles.

The small clearance causes the rotating drive components of the engine to constantly dip into the oil flowing off from the floor part of the oil space into the oil sump. As a result, substantial volumes of oil are pulled up onto the rotating drive components, leading to relatively intense foaming within the crankcase. The foaming in turn causes a reduction in lubricating action leading to the reductuion in engine performance.

The aforementioned U.S. Letters Patent addresses this problem by providing ribs in the oil space to counteract a delay in oil discharge. The ribs should accelerate the oil supply and thus counteract a reduction in the permanent quality of oil in the sump and the tendency for oil temperature to rise. It has been found, however, that these desirable objects are not satisfactorily achieved because of the rib arrangement and their cooperation with the driving parts of the engine. A design which more satisfactorily achieves these objects and overcomes other deficiencies of prior art engine design would represent a significant advance in the art.

OBJECTS AND SUMMARY OF THE INVENTION

It is a primary object of the present invention to reduce oil adulteration in internal combustion engines for vehicles, especially for motorcycles, and to thereby improve engine performance.

It is another object of the present invention to provide a crankcase design for internal combustion engines which includes oil ducts arranged in the space between the envelope of travel of the crank webs and the floor of the crankcase.

It is yet another object of the present invention to provide an effective means for returning oil to the oil sump without adulteration of same.

A different object of the present invention is to provide a crankcase configuration which permits the accomplishment of the foregoing objects yet still provides space in the crankcase to accommodate engine auxiliary units, thereby resulting in space saving in the overall engine design.

A still further object of the invention is to provide a specific arrangement of oil duct ribs with respect to the crank webs and the connecting rod heads and the arrangement of the oil ducts themselves so that the oil is guided into predetermined paths and is agitated so that the oil can flow off more quickly towards the oil sump.

Another object of the invention is to provide a juxtaposition of the rotating driving parts, in particular, the crank webs, of the engine above the ducts in the vicinity of duct opening so that a suction effect is created and so that oil is taken up by the driving parts in accordance with rotation.

Another object of the invention is to provide that the space between the oil return ducts, in which the connecting rod head rotates, be largely closed off from oil flow so that oil adulteration in this area is minimized, if not entirely eliminated.

A further object of the present invention is to arrange and design the oil return ducts to achieve a gain in effective power, a reduction in oil temperatures, the more rapid agitation of the oil to free it from constituents of air and increase the quiet running of the internal combustion engine.

A different object of the invention is to provide an oil sump which is not particularly deep, which is made possible by the improvement in the permanent condition of the oil and which is advantageous from the point of view of ground clearance of the vehicle.

Another object of the present invention is to provide a contracted lower part of the crankcase in the region of the crank webs to thereby form a free space and an external recess which may be used for receiving an auxiliary unit, such as, for example, a starter motor.

Yet another object of the present invention is to raise the height of the oil return ducts close to the end faces of the crank webs so that rotation is still possible, but at the same time, the effect of taking up oil, oil mist, etc. is considerably improved without a substantial immersion of the webs in the oil.

A different object of the present invention is to provide a guiding rib on the inflow side of the oil ducts to initiate oil flow, the rib forming a funnel-shaped inlet of a floor surface of the lower part extending slightly obliquely to the ducts.

How these and other objects of the present invention are accomplished will be described in the following description of the preferred embodiment of the invention, taken in conjunction with the drawings. Generally, however, the objects are accomplished by providing a crankcase for internal combustion engines, particularly for motorcycles, which has an upper and lower part, between which a crank shaft is mounted. The lower part includes an oil space and an oil sump and the crank webs of the crank shaft rotate in the oil space. The lower part of the crankcase has a curved shape floor which is formed at a distance from the envelope of travel of the crank webs, and oil return ducts on the floor are provided in the vicinity of the path of movement of the crank webs. The ducts are located opposite to the crank webs to form constricted oil return ducts which have a slope and which extend between the walls of the bearing seats of the crank shaft. In the preferred embodiment, the ducts are located very close to the crank webs to produce a suction effect and a funnel-shaped oil inlet is provided by the duct configuration and a curved shape facing the oil return flow. Also in the preferred embodiment, the crankcase is configured to contain an auxiliary unit, such as a starter motor, a feature made possible by the shape of the crank case floor and oil return ducts.

DESCRIPTION OF THE PREFERRED EMBODIMENT

Figure 1:
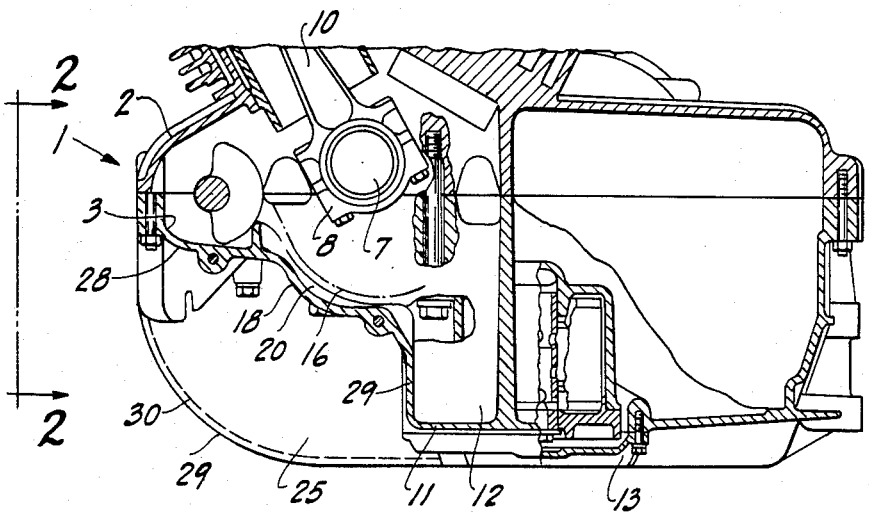
FIG. 1 is a longitudinal cross section through the lower part of a crankcase according to the preferred embodiment of the present invention showing the oil return ducts.

The figures generally depict a crankcase 1 which essentially comprises an upper part 2 and a lower part 3. The two parts are joined together in a sealed manner. Located between the crankcase parts 2 and 3 is a crank shaft 7 which comprises a head of a connecting rod 10 located between crank webs 8 in each of the several cases, the latter in turn being mounted in bearing seats 4, 5, and 6.

Figure 2:
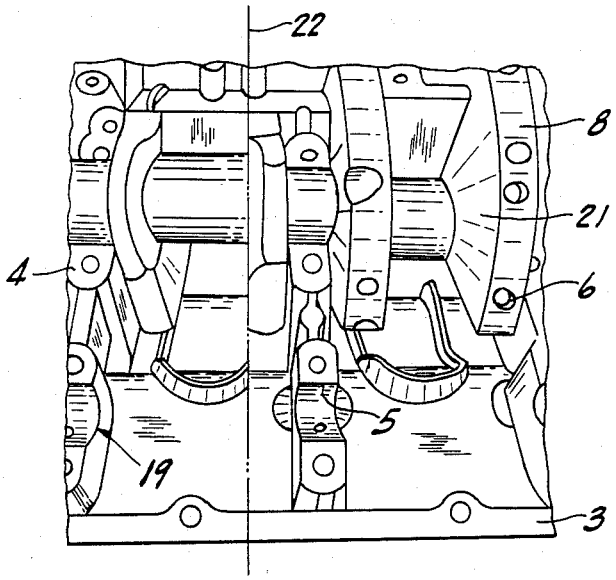
FIG. 2 is a view taken along the line 2 of FIG. 1 looking into the lower part of the crankcase and looking toward the crank webs.
Figure 3:
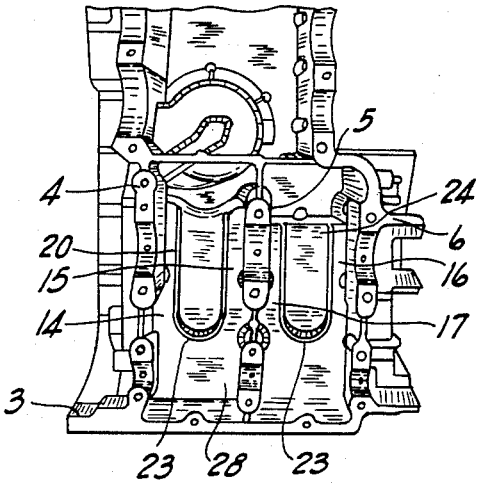
FIG. 3 is a plan view through the crankcase showing the oil return ducts in the lower part of the crankcase; and, FIG. 4 is a front view of the crankcase showing the external recess in the lower part thereof.
Figure 4:
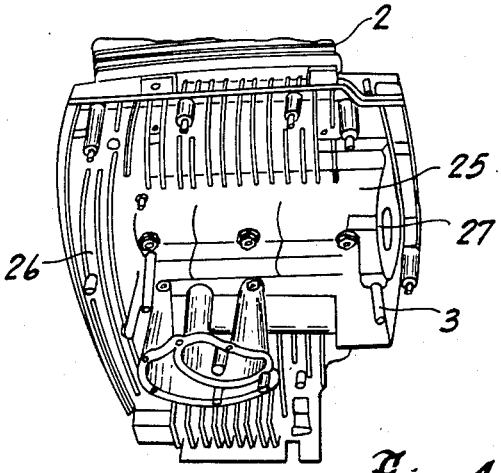

The lower part 3 of the crankcase 1 includes a floor 11 which forms an oil space 12 and a deeper part 13 which receives the oil and acts as an oil pump. The oil return ducts 14, 15, 16, and 17 according to the present invention are located on the floor 11 in the vicinity of the path of movement of the crank webs 8, so that the oil dripping from the points of the internal combustion engine being lubricated will fall on floor 11 and be rapidly guided to the sump 13. The ducts are illustrated best in FIGS. 2 and 3.

According to the present invention, another floor 18 having a curved shape is formed at a distance from the envelope curve of travel of the crank webs 8, such floor being the location of the oil return ducts 14–17. The duct openings on the upper side are directly opposite the end faces of the crank webs 8 and extend, in each case, between a wall 19 of the respective bearing seats 4, 5 and 6 and a rib 20 extending approximately parallel thereto. Only one reference numeral is used in each case for the walls 19 of the bearing points and for the ribs of the four ducts, as these parts are identical in each case. Ducts 14–17 form a constricted oil return duct with a defined cross section in the region of the envelope of travel of the crank webs 8.

The ribs 20 of ducts 14–17 are each disposed in a plane 22 formed by the inner surface 21 of the crank webs 8 and the distance from the end face of crank webs 8 is just large enough that an unobstructed rotational movement of the crank webs is possible. Because of the close juxtaposition of the end faces of crank webs 8 and the openings of ducts 14–17, a suction effect is exerted on the return oil flow. The oil return ducts 14–17 preferably extend along the entire range of the path of movement of the crank webs 8 and are each provided with an oil guiding rib 23 on the oil inflow side. Rib 23 forms an oil inlet 28 in the approximate shape of a funnel with the wall 19 of the bearing seats. For this purpose, the ribs 23 have a curved shape oriented toward the oil return flow. Moreover, the duct ribs 20 of two adjacent ducts, for example, ducts 14 and 15 or ducts 16 and 17 are connected by one guiding rib 23. As a result, the space 24 remaining between the ducts is closed at the inflow side, thus ensuring an unobstructed circulation of the connecting rod heads without oil adulteration.

The accomplish the objects of the invention relating to auxiliary units, it will be noticed that because of the shape of floor 18 (which receives the portion of oil return ducts 14–17), an open recess 25 is simultaneously formed in the crankcase. The floor 18 forms the inner wall of this recess. Recess 25 is also bounded by lateral walls 26 and 27 and may be used for the snug addition of an auxilliary unit, such as, for example, a starter motor. The unit contained in recess 25 is not shown in detail. The recess is closed off externally by a cover or the like. In the longitudinal plane, the recess 25 has a roughly angled cross-section, as shown in greater detail in FIG. 1, the floor 18 which receives the portion of the oil return ducts 14–17 being provided with a slight slope to the oil sump 13. A further floor portion 28, extending approximately horizontally, is brought up to the vertical outer wall of the lower part 3 of the crankcase and a further vertical floor portion 29 is brought up to the horizontal outer wall of the crankcase.

While the present invention has been described by reference to a preferred embodiment, it is not to be limited thereby, but is to be limited solely by the claims which follow.

I claim:

1. In an internal combustion engine for motorcycles, said engine having a crankcase including an upper part and a lower part and a crankshaft mounted therebetween, said lower part including an oil space and an oil sump arranged at a lower level than said oil space, said crankshaft having crank webs mounted thereon which rotate partially in said lower part and said crankshaft being mounted in bearing seats having walls, the improvement comprising:

a curved shape floor in said lower part, said floor being spaced apart from the envelope sleeve defined by the paths of travel of said crank webs, constricted oil return ducts in said floor disposed opposite said crank webs and in the paths of movement thereof, said ducts having a slope and extending between the walls of said bearing seats, said ribs being disposed on said floor and said oil return ducts being formed between said ribs and said walls of said bearing seats.

2. The invention set forth in claim 1 wherein said crank webs have inner faces and wherein said ribs extend vertically from said floor in a plane coinciding with the plane of the inner faces of said crank webs.

3. The invention set forth in claim 1 wherein said ribs are located near said crank webs but are spaced apart therefrom by a clearance sufficient to permit rotational movement of said crankshaft.

4. The invention set forth in claim 1 wherein said oil return ducts extend over the entire path of travel of said crank webs and include a guiding rib on the inflow side.

5. The invention set forth in claim 4 wherein each of said guiding ribs is arranged whereby a funnel shaped oil inlet to said oil ducts is formed adjacent the walls of said bearing seats.

6. The invention set forth in claim 5 wherein a guiding rib connects adjacent pairs of said ribs between said bearing seats, said guiding rib having a curved shape facing the oil return flow on the inflow side.

7. The invention set forth in claim 1 wherein said curved floor forms an inner wall of a recess in the lower part of said crankcase, and wherein wall on said crankcase provide a boundary around said recess.

8. The invention set forth in claim 1 wherein said floor terminates in a vertical and downwardly extending portion forming part of a wall for an oil chamber and wherein said oil return ducts open into said chamber.

9. The invention set forth in claim 7 further including a cover for said recess.

10. In an internal combustion engine having a crankcase including an upper part and a lower part and a crankshaft mounted therebetween, said lower part including an oil space and an oil sump arranged at a lower level than said oil space, said crankshaft having a connecting rod head and crank webs mounted thereon which rotate partially in said lower part and said crankshaft being mounted in bearing seats having walls, the improvement comprising:

a curve shaped floor in said lower part, said floor being spaced apart from the envelope sleeve defined by the path of travel of said crank webs, constricted oil return ducts on said floor and disposed opposite said crank webs and below the path of movement thereof, said ducts having a slope and extending between the walls of said bearing seats, said ducts being disposed on the opposite sides of the path of travel of said connecting rod head so that said connecting rod head and said crank webs do not splash the oil in the ducts as said crankshaft rotates.

11. The invention set forth in claim 10 wherein ribs are disposed on said floor and said oil return ducts are formed between said ribs and the walls of said bearing seats.

12. The invention set forth in claim 11 wherein said crank webs have inner faces and wherein said ribs extend vertically from said floor in a plane coinciding with the plane of the inner faces of said crank webs.

13. The invention set forth in claim 11 wherein said ribs are located near said crank webs but are spaced apart therefrom by a clearance sufficient to permit rotational movement of said crankshaft.

14. The invention set forth in claim 10 wherein said crank webs have end faces which form the said sleeve of travel and said end faces are located opposite the openings of said oil return ducts, whereby a suction effect is created for oil in said lower part.

15. The invention set forth in claim 11 wherein said oil return ducts extend over the entire path of travel of said crank webs and include a guiding rib on the inflow side.

16. The invention set forth in claim 15 wherein each of said guiding ribs is arranged whereby a funnel shaped oil inlet to said oil ducts is formed adjacent the walls of said bearing seats.

17. The invention set forth in claim 16 wherein a guiding rib connects adjacent pairs of said ribs between said bearing seats, said guiding rib having a curved shape facing the oil return flow on the inflow side.

18. The invention set forth in claim 10 wherein said curved floor forms an inner wall of a recess in the lower part of said crankcase, and wherein wall on said crankcase provides a boundary around said recess.

19. The invention set forth in claim 10 wherein said floor terminates in a vertical and downwardly extending portion forming part of a wall for an oil chamber and wherein said oil return ducts open into said chamber.

* * * * *